United States Patent [19]

Jackson

[11] 4,127,046

[45] Nov. 28, 1978

[54] COMBINATION PORTABLE AND STATIONARY, BENCH-MOUNTED CHAIN SAW APPARATUS

[76] Inventor: Edward L. Jackson, P.O. Box 636, Pauls Valley, Okla. 73075

[21] Appl. No.: 741,716

[22] Filed: Nov. 15, 1976

[51] Int. Cl.[2] ..... B27B 17/02

[52] U.S. Cl. ..... 83/798; 83/799; 83/490; 83/574; 83/802

[58] Field of Search ..... 83/794, 796, 797, 798, 83/799, 800, 801, 802, 574, 490

[56] References Cited

U.S. PATENT DOCUMENTS

| | | | |
|---|---|---|---|
| 1,123,783 | 1/1915 | Muir | 83/798 |
| 2,851,067 | 9/1958 | Greenslate | 83/796 |
| 3,385,330 | 5/1968 | Haynes | 83/802 |
| 3,433,277 | 3/1969 | Ribley | 83/796 |
| 3,771,395 | 11/1973 | Heimert | 83/797 |
| 3,821,918 | 7/1974 | Mehaus et al. | 83/490 |

*Primary Examiner*—Donald R. Schran
*Attorney, Agent, or Firm*—William R. Laney

[57] ABSTRACT

Apparatus for sawing which can be used either in portable, manually operated form, or as a stationary bench-mounted sawing device for sawing through a workpiece along predetermined angles of cut. The apparatus comprises a portable chain saw which includes a prime mover secured to one side of a flat mounting plate. A saw blade guide plate projects from the prime mover through a slot provided in the mounting plate, and in a plane substantially normal to the plane of the mounting plate. A saw blade is extended around, and guided by, the guide plate, and is protected by guard means pivotally mounted on the mounting plate. A cradle frame structure releasably receives and clamps the mounting plate in a table sawing position when the chain saw is to be so used. A cradle frame pedestal pivotally supports the cradle frame structure for pivotation about a horizontal axis. A pivotally supported turntable is positioned beneath and supports the pedestal, with the turntable and associated pedestal being pivotable about a vertical axis. A workpiece-supporting table is positioned adjacent the cradle frame structure, pedestal and turntable, and has a substantially horizontal working surface located below the guide plate of the chain saw.

11 Claims, 4 Drawing Figures

COMBINATION PORTABLE AND STATIONARY, BENCH-MOUNTED CHAIN SAW APPARATUS

BACKGROUND OF THE INVENTION

1. Field of the Invention

This invention relates to sawing apparatus, and more particularly, to an apparatus increasing the versatility of usage of portable chain saws by adapting such saws to utilization for cutting a workpiece along a fixed predetermined angle, and other stationary or bench usage.

2. Brief Description of the Prior Art

Chain saws are highly effective cutting devices for field work in felling trees and trimming limbs therefrom, as well as for other sawing tasks which involve cutting through relatively large wooden members which are stationarily located, or are, at least, difficult to reach and cut except in the field. Chain saws as presently constructed are portable, and generally include a handle by which the saw can be lifted and manipulated. The types of chain saws currently manufactured and utilized vary considerably in their construction, but nevertheless are generally characterized in having a chain saw blade supporting and guiding plate upon which the saw blade tracks during cutting. Many chain saws have also been heretofore proposed which include various types of guard structures which are intended to function to guard the saw blade during its movement and use to prevent injury to the user.

Although the weight of the various types of chain saws heretofore provided varies considerably from the smallest to the largest size, even the smallest chain saw is relatively heavy (many times heavier, for example, than a hand saw), and such weight makes it difficult to use the chain saw to effect precision cutting of a small wooden workpiece along a preselected line of cut. Moreover, the weight and method of construction of chain saws is such that it is often extremely difficult to cut small, unsupported or unanchored pieces of wood with this type of saw. In general, these characteristics make chain saws unsuited for home use and craft projects, or in carpentry operations where precision cutting of relatively small wooden workpieces is entailed.

Various types of stationary bench-mounted saw devices have previously been manufactured for providing the cutting capacity and power inherent in chain saw structures, yet permitting precision cutting as required in carpentry and for many types of home crafts. Thus, certain types of radial saws, as well as band saws, have been provided on various types of jigs or stands, and have been susceptible to movement in several planes to allow cutting in different planes in order to effect mitered cuts, or preselected bias cuts, in various sizes of workpieces. In general, however, most of the types of saw structures which have been provided for such usage have not been susceptible to transport to field locations where they may be manipulated by hand—that is, readily located and relocated at will in any location which may be desired by the user. Moreover, such structures are, in general, entirely unsuited to felling and trimming trees.

In an effort to realize the advantages of portability and the concomitant flexibility in types of field cutting which is characteristic of chain saw utilization, various proposals have heretofore been made for detachably or temporarily mounting various types of portable power saw structures on supporting platforms or jigs to permit them to be held steadily and stationarily at a fixed location to effect a desired angle of cut, or a particular sawing operation. Some of these types of structures have included platforms or stands upon which chain saws can be mounted, and others have contemplated the demountable, temporary support of radial saws or other types of saws. Examples of patents which depict and describe a chain saw mounting structure for permitting a chain saw to be used as a table saw in woodworking and carpentry are U.S. Pat. No. 2,851,067; French Pat. No. 1,384,843; German Pat. No. 740,065; French Pat. No. 1,031,907; Swiss Pat. No. 374,192; and German Pat. No. 690,791. In the case of each of these patents, however, the structures in which the chain saws are mounted to permit a table sawing application to be achieved are such that the mounting of the saw in the structure for effecting a desired cut is time-consuming, and requires several manipulations using various types of hand tools. Moreover, the types of cuts, as well as the sorts of workpieces which can be cut with the structures thus provided, are, in all cases, limited to certain specialized cutting operations. Thus, the chain saw mounting stand shown in French Pat. No. 1,384,843 is, in reality, best adapted and utilized primarily for cutting logs into relatively short segments (such as firewood), and is unsuited for cutting mitered cuts along a particular, preselected angle. The same limitation is generally characteristic of the saw mounting framework shown in German Pat. No. 690,791. In Greenslate U.S. Pat. No. 2,851,067, cutting is effected by upward movement of the saw blade through the workpiece located on top of a supporting table, and it is thus not possible to perceive the line of cut of the blade as it enters the workpiece. Cutting of the saw is also limited to a single vertical plane in the case of the Greenslate chain saw table.

BRIEF DESCRIPTION OF THE PRESENT INVENTION

The present invention provides a multi-purpose sawing apparatus which includes, as a portion of the structure, a portable chain saw which can be manually located in a stationary holding structure to effect precision cuts, and cuts of a workpiece at a predetermined angle, or can be quickly manually demounted from the stationary holding structure. The mounting and demounting of the saw, as well as all cutting manipulations performed therewith, can be performed by a single person without the aid of any hand tools.

Broadly described, the chain saw apparatus of the invention comprises a portable chain saw which includes a mounting plate by which the chain saw can be quickly and easily mounted in a cradle frame forming a part of a stationary holding structure utilized in conjunction with the chain saw when the saw is to be employed for precision cutting and various types of stationary or non-field usage. In addition to the cradle frame which releasably receives and holds the mounting plate of the chain saw, the stationary structure includes a cradle frame pedestal which pivotally supports the cradle frame for pivotation about a horizontal axis, and a pivotally supported turntable on which the cradle frame pedestal is mounted, and which facilitates pivotal movement of the cradle frame and saw about a vertical axis. A workpiece-supporting table is located adjacent the cradle frame, the pedestal and the turntable, and includes a substantially horizontal working surface which is located below the guide plate and chain saw blade of the chain saw for supporting a workpiece during cutting.

In a preferred embodiment of the invention, the portable chain saw includes a blade guard structure which is pivotally mounted on one side of the mounting plate used for supporting the chain saw in the cradle frame, and the blade guard projects out over the saw blade guide plate and the chain saw blade so as to protect the exposed upper run of the chain saw blade, both from above and from the sides, during use of the saw apparatus in the stationary mode.

An important object of the invention is to provide a novel sawing apparatus which can be quickly and easily adapted for use, either in a portable mode in which a chain saw susceptible to the normal and usual chain saw field usages is provided, or in a stationary mode in which the chain saw is held rigidly in any one of several preselected positions over a workpiece-supporting table in order to permit the saw to be used to make precision cuts or cuts through the workpiece at a preselected angle.

A further object of the invention is to provide a bench-mounted chain saw apparatus by which a portable chain saw can be quickly and easily, and without the use of hand tools, adapted for usage in woodworking, cutting small pieces of wood and forming precision cuts through various workpieces.

Another object of the invention is to provide a versatile chain saw apparatus which has multiple usages, but which is relatively simple in its construction and can be easily and relatively inexpensively manufactured.

Another object of the invention is to provide a combination portable and stationary, bench-mounted chain saw apparatus which is characterized in having a long and trouble-free operating life.

Yet another object of the invention is to provide a combination portable and stationary, bench-mounted chain saw which affords maximum safety to the user of the apparatus by providing effective blade guards which are positioned in the various modes of usage to provide a constant guard against contact between the operator of the apparatus and the saw blade.

Additional objects and advantages of the invention will become apparent as the following detailed description of a preferred embodiment of the invention is read in conjunction with the accompanying drawings which illustrate such preferred embodiment.

DETAILED DESCRIPTION OF A PREFERRED EMBODIMENT OF THE INVENTION

Figure 1:
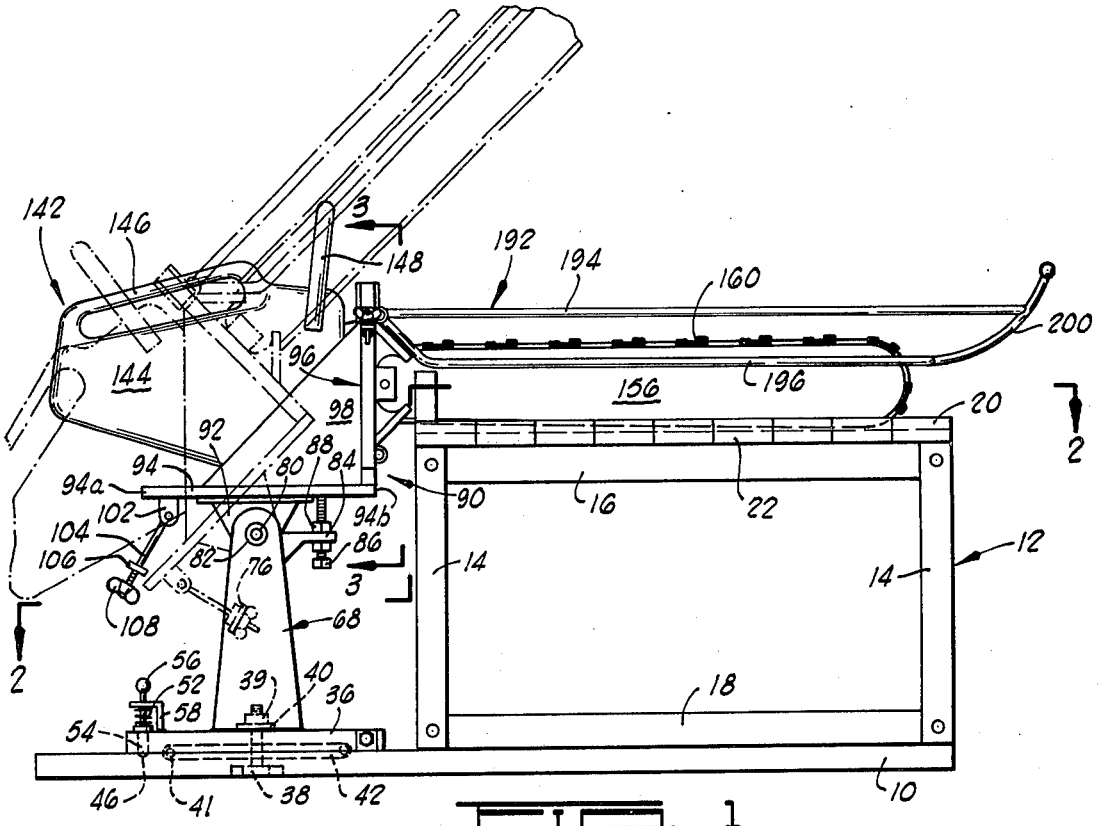
FIG. 1 is a side elevation view of the combination portable and stationary, bench-mounted chain saw apparatus of the invention. An alternate position which parts of the apparatus may assume during its use is illustrated in phantom lines.

The combination portable and stationary bench-mounted chain saw apparatus of the invention is illustrated in side elevation in FIG. 1 of the drawings. The apparatus includes a supporting base member 10 which, in the illustrated embodiment, is a generally rectangular, substantially flat structure adapted to rest upon the floor, and to support the saw apparatus on its upper side. Mounted on the upper side of the base member 10 along one of the side edges thereof is a workpiece-supporting table designated generally by reference numeral 12. The workpiece-supporting table 12 includes a plurality of vertically extending frame members 14 which are interconnected at the upper and lower ends by horizontally extending top frame members 16 and horizontally extending bottom frame members 18, respectively. A workpiece-supporting deck 20 is secured across the upper side of the table 12 and includes a plurality of transversely extending, juxtapositioned planks or boards 22 which are supported upon, and secured to, the horizontally extending top frame members 16.

Figure 2:
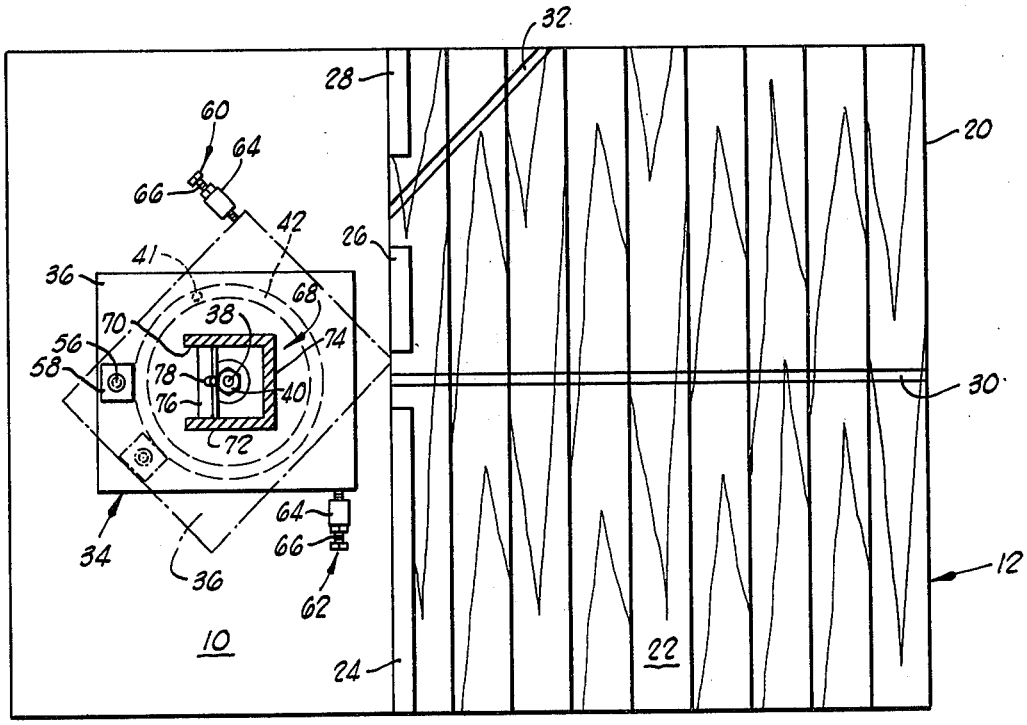
FIG. 2 is a sectional view taken along line 2—2 of FIG. 1.

Along one edge of the deck 20, and above a generally median portion of the base member 10, a plurality of guide rails 24, 26 and 28 are secured to the deck to project upwardly from the deck along one edge thereof to form a stop or barrier against which a board, limb or wooden workpiece to be sawed can be abutted and retained to assure proper positioning in relation to the saw blade during the cutting operation. It will be noted in referring to FIG. 2 of the drawings that the guide rails 24 and 26 define between them, a gap or space which is disposed at a location halfway across the deck 20, and that this gap between the guide rails 24 and 26 is in direct alignment with a sawing groove 30 which extends transversely across the deck 20 in a direction normal to each of the planks 22 which make up the deck. The groove 30 is relatively shallow, and is not cut deeply into the planks 22 so as to weaken the deck. The function of the groove 30 will be hereinafter explained.

Another gap or space is defined between the facing ends of the guide rails 26 and 28, and a bias cut sawing groove 32, which is cut into the upper surfaces of several of the planks 22 of the deck 20, has one of its ends centrally disposed in the space between the guide rails 26 and 28, and extends at an angle of 45° to the adjacent intersecting side edges of the deck 20. The groove 32 is of substantially the same depth as the groove 30 and will also be perceived to extend, when projected, at an angle of 45° with respect to the longitudinal axis of the groove 30.

A turntable, designated generally by reference numeral 34, is pivotally or swingably supported on the base member 10 on the opposite side thereof from the table 12. The turntable 32 includes a flat, substantially rectangular plate 36 which is pivotally retained on the upper side of the base member 10 by a bolt 38 which is projected through suitable apertures in the base member 10 and the turntable plate 36, and is threadedly engaged by a nut 39 adjacent a washer 40.

The plate 36 is movable on trunnion bearings 41 which are adapted to roll in a raceway 42 formed by annular, semicircularly cross-sectioned, complementary grooves formed in the lower side of the plate 36 and in the upper side of the base member 10. For the purpose of arresting the swiveling or pivoting movement of the plate 36 of the turntable 34, a spring-biased ball element 46 is mounted in the lower end of an aperture which extends through the plate 36, and is positioned so that the lower portion of the ball can drop into, and provide an interlock with, a pair of hemispherical recesses or cavities formed at spaced locations in the base member 10. These locations are displaced by an angle of 45° from each other as measured around the outer periphery of the bearing raceway 42 hereinbefore described. When the ball element 46 is in its interlocking position, it is retained in the interlocking status by means of a resilient biasing structure which includes a coil spring 52 which bears against a hub 54 carried on a plunger 56. When the spring 52 is fully extended, the plunger 56 bears against the upper side of the ball to hold it down in its interlocking position. The upper end of the spring 52 bears againt an L-shaped bracket 58 welded or otherwise suitably secured to the upper side of the plate 36 of the turntable 34.

Cooperating with the described ball stop structure in fixing the turntable 34 in one of two preselected positions are a pair of adjustable stop subassemblies designated generally by reference numerals 60 and 62. Each of the adjustable stop subassemblies includes a post 64 which projects upwardly from the upper side of the base member 10 and threadedly receives an adjusting screw 66. The adjusting screw 66 can be threaded through the respective post 64 to a preselected extent so that, when one side edge of the plate 36 of the turntable 34 bears thereagainst, the turntable will occupy a preselected position in relation to the table 12. One of these positions, and employing the stop subassembly 60, is shown in dashed lines in FIG. 2, and the other of the two positions, in which the stop subassembly 62 is utilized, is shown in solid lines.

A cradle frame pedestal subassembly, designated generally by reference numeral 68, is constituted by a pair of side plates 70 and 72 which are interconnected at one edge by a back or web plate 74. The lower ends of the plates 70, 72 and 74 are welded to the upper side of the plate 36 of the turtable 34 at a position such that the pedestal subassembly 68 straddles the bolt 38, and thus is symmetrically mounted over the vertical pivotal axis of the turntable 34. The pedestal subassembly 68 further includes a centrally relieved latching bar 76 which extends between the legs 70 and 72 at a location substantially intermediate the height of each of the legs. The latching bar 76 is angled out of a vertical plane, as shown in FIG. 1, for a reason hereinafter described, and is provided with a notch or relief 78 extending downwardly from the top edge thereof and located about midway between the ends of the latching bar.

Adjacent its upper end, the pedestal subassembly 68 further includes a rocking shaft 80 which has its ends journaled in a pair of journal sleeves 82 positioned in the upper end portions of the plates 70 and 72. A bracket plate 84 is welded or otherwise suitably secured to the outer side of the web plate 74 near the upper end thereof, and projects substantially horizontally from the web plate toward the table 12. The bracket plate 84 is apertured to permit an adjustable stop screw 86 to be extended therethrough, and to be retained in a preselected position by means of a pair of locking nuts 88.

A cradle frame subassembly 90 is pivotally mounted on the upper end of the pedestal subassembly for pivotation about a horizontal axis coinciding with the axis of the rocking shaft 80. A pair of pivot plates 92 are each keyed or secured to the rocking shaft 80, and are further secured along an upper edge thereof to the lower side of a base plate 94 forming a portion of the cradle frame subassembly 90. The base plate 94 is characterized in having a rear edge **94*a* and a forward edge 94*b*, and supports and is secured to a cradle frame designated generally by reference numeral 96. The cradle frame 96 is aligned with the forward edge 94*b* of the base plate 94 and projects vertically therefrom. The cradle frame 96 is structurally reinforced by means of a relatively large triangularly shaped gusset plate 98 secured between the cradle frame and the upper side of the base plate 94, and also by means of a smaller triangularly shaped gusset plate 100 which is similarly positioned, but at the opposite side of the cradle frame subassembly. This spaced relationship of the gusset plates 98 and 100 is best illustrated in FIG. 4** of the drawings.

At a medial portion of the rear side of the base plate 94, a pair of spaced latching lugs 102 are secured to the under side of the base plate and project downwardly therefrom. The latching lugs 102 function to pivotally support the cross-bar portion of a T-shaped latching rod 104 which carries at its free end remote from the latching lugs 102, an external thread and a fixed stop collar 106. A wing nut 108 is threaded upon the threaded end portion of the latching rod 104. This mechanism is utilized in conjunction with the latching bar 76 for locking the cradle frame subassembly 90, and a portable chain saw carried thereby, in an upwardly inclined position as shown in dashed lines in FIG. 1, and for a purpose hereinafter described.

Figure 3:
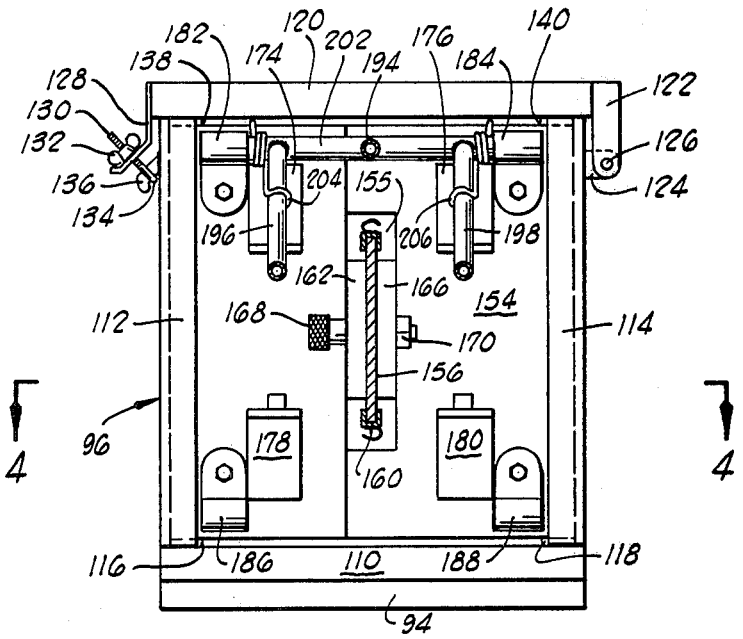
FIG. 3 is a view taken along line 3—3 of FIG. 1.
Figure 4:
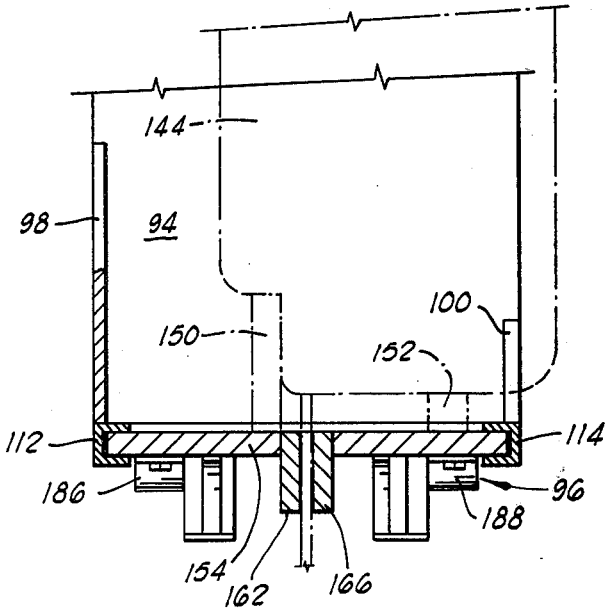
FIG. 4 is a sectional view taken along line 4—4 of FIG. 3.

The cradle frame 96 constitutes a major sub-element of the cradle frame subassembly 90, and its structure is best illustrated in FIGS. 3 and 4. The cradle frame 96 includes a bottom, transversely extending frame element 110 which is preferably a solid member, and which is secured to the upper side of the base plate 94. The frame element 110 is connected at its opposite ends to a pair of substantially vertically extending channel frame elements 112 and 114 which are each of substantially C-shaped cross-sectional configuration as shown in FIG. 4. As further shown in FIG. 4, the large gusset plate 98 has its forward vertical edge secured to the channel frame member 112. In similar fashion, the small gusset plate 100 has its forward edge secured to the outer side of the channel frame member 114. Mounted within the recess defined by the two channel frame members 112 and 114 at the lower ends of each of these channel members, and secured to the upper surface of the transverse channel member 110, are a pair of resilient cushioning pads 116 and 118 (see FIG. 3).

For the purpose of opening and closing the cradle frame 96, a pivotally mounted, transversely extending closure bar 120 is provided and constitutes the upper frame element of the cradle frame. The closure bar 120 has a pivot link 122 secured to one of its ends which projects past the channel frame member 114. The pivot link 122 extends normal to the longitudinal axis of the closure bar 120, and has a free lower end which is pivotally connected to a suitable pivot bracket 124 by means of a pivot pin 126. At its end opposite the end which carries the pivot link 122, the closure bar 120 is provided with a slotted, angulated securing plate 128 which carries, by extension through the slot formed therein, a threaded shaft 130 having a wing nut 132 threaded thereon, and further having a circular eye 134 at the inner end thereof. The circular eye 134 is dimensioned to be hooked over a latching protuberance 136 secured to the outer side of the web portion of the channel frame member 112.

The thickness of the closure bar 120, which is a solid member, is such that the closure bar extends across and closes the cavities defined by the channel members 112 and 114. On its lower surface relatively near to each of its opposite ends, closure bar 120 carries a pair of cushioning pads 138 and 140 which are dimensioned to extend into the recess defined within each of the channel frame members 112 and 114. The function of the cushioning pads 138 and 140 will be hereinafter explained.

A portable chain saw structure which is included in the combination of the sawing apparatus of the invention is designated generally by reference numeral 142. The chain saw includes a prime mover which is encased within a conventional housing 144 having a handle 146 at the upper rear side thereof. A second handle 148 is secured to the forward side of the housing, and facilitates manipulation of the chain saw 142 when it is utilized in its portable status.

The housing 144 of the chain saw 142 is secured by suitable securement plates or lugs 150 and 152 to a flat, substantially rectangular mounting plate 154. The rectangular mounting plate 154 is provided with a slot 155 in the central portion thereof to facilitate the extension through the mounting plate of a saw blade guide plate 156. The saw blade guide plate 156 is of substantially conventional construction and configuration, and it functions to provide a guiding structure upon which the chain saw blade runs during operation of the saw. The chain saw blade 160, as illustrated in the drawings, runs and tracks on the edges of the guide plate 156, and extends through the slot 155 into the housing 144, where it meshingly engages a driving sprocket (not visible) of conventional construction.

A first clamping plate 162 is secured to the mounting plate 154 at a side edge of the slot 155 and projects normal to the opposite side of the mounting plate from that side to which the housing 144 is secured. A second clamping plate 166 is mounted on the opposite side of the guide plate 158 from the clamping plate 162 and has one end secured to the mounting plate at the opposite side edge of the slot 155. A clamping bolt 168 and associated nut 170 are provided, with the shank of the bolt extended through aligned apertures in the clamping plates 162 and 166, and through an aligned slot (not visible) extending longitudinally in the guide plate 156. The described clamping plate and clamping bolt structure permits the guide plate 156 to be moved slightly in a longitudinal direction in a conventional manner for the purpose of adjusting the tension in the chain 160.

It will be noted in referring to FIGS. 3 and 4 that the mounting plate 154 is configured and dimensioned to slidingly fit within the cradle frame 96. Thus, the side edges of the mounting plate slide within the recesses defined by the channel frame members 112 and 114, and the mounting plate, at its lower edge, rests upon the cushioning pads 116 and 118. After the mounting plate 154 is slidably inserted in the cradle frame 96 in this manner, the closure bar 120, which has previously been pivoted to an open position, is pivoted to a closing position as shown in FIG. 3 of the drawings. In this position, the cushioning pads 138 and 140 are compressed, and a slight downward force is made to act upon the mounting plate 154 so that the lower edge thereof is forced down against the cushioning pads 116 and 118. The closure bar 120 is locked or clamped in its closing position by extending the eye 134 of the shaft 130 over the stud 136, and then tightening the wing nut 132 against the slotted securing plate 128. It will be noted in referring to FIGS. 1 and 4 that, when the mounting plate 154 is positioned in the cradle frame 96 in the manner described, the housing 144 which encloses the engine of the portable chain saw is offset to one side of the triangular gusset plate 98, and extends over the relatively small gusset plate 100.

On the face of the mounting plate 154 opposite the side thereof upon which the prime mover housing 144 is mounted, certain blade guard structure is affixed to the mounting plate and functions to permit one or more blade guards to be pivotally secured to the mounting plate in positions to guard against inadvertent contact with the saw blade by the operator of the apparatus. The blade guard structure thus provided includes a pair of upper blade guard stop plates 174 and 176 which are welded to the mounting plate 154 and function to arrest pivotal movement of a blade guard, hereinafter described, toward the saw blade 160 and blade guide plate 156 when the blade guard has reached a protective and guarding position as hereinafter described.

In similar fashion, a pair of horizontally spaced lower blade guard stop plates 178 and 180 are welded to the lower side of the mounting plate 154 directly below the stop plates 174 and 176. It will be noted that the upper blade guard stop plates 174 and 176 are disposed on opposite sides of the plane in which the saw blade guide plate 156 is disposed, and the same positional relationship is characteristic of the lower guard stop plates 178 and 180. A pair of spaced upper journal brackets 182 and 184 are bolted to the mounting plate 154 near the upper side thereof, and are positioned outwardly of the two guard stop plates 174 and 176—that is, are spaced on opposite sides of the guard stop plates. In similar fashion, a pair of spaced lower journal brackets 186 and 188 are bolted to the mounting plate 154 near the lower edge thereof, and are spaced outwardly on the mounting plate from the lower guard stop plates 178 and 180.

When the portable chain saw 142 is mounted in the cradle frame 96 and utilized for table sawing in a manner hereinafter described, an upper blade guard subassembly, designated generally by reference numeral 192, is utilized for the purpose of protectively shielding the upper run of the saw blade 160 as it traverses the blade guide plate 156. The upper blade guard suabassembly 192 is constructed substantially identically to the corresponding structure illustrated and described in Cartmill U.S. Pat. No. 3,991,470, and for purposes of disclosing the details of such construction, such patent is incorporated herein by reference. Generally, however, the upper blade guard subassembly 192 includes an elongated upper guard bar 194 which is disposed above the saw blade 160, and is located in substantially the same plane as the blade guide plate 156. The guard subassembly 192 also includes a pair of lateral guard bars 196 and 198 which project alongside the saw blade 160 and saw blade guide plate 156 at locations to shield the saw blade from lateral contact by the operator. The lateral guard bars 196 and 198 coverge at their outer ends to form a loop extending around the outer end of the blade 160 and guide plate 156, and the upper guard bar 194 is joined to the convergent lateral guard bars 196 and 198 by an arcuate horn portion 200 which projects from the outer end of the saw.

As also explained in detail in Cartmill U.S. Pat. No. 3,991,470, the ends of the upper guard bar 194 and the lateral guard bars 196 and 198 which are adjacent the mounting plate 154 are welded or otherwise suitably secured to a transversely extending pivot bar 202 which has its opposite ends pivotally journaled in the spaced upper journal brackets 182 and 184. A pair of torsion springs 204 and 206 are mounted with convolutions around the transversely extending pivot bar 202, and with the opposite ends thereof bearing against the mounting plate 154 and the respective lateral guard bars 196 and 198. The torsion springs 204 function to constantly resiliently urge the upper blade guard subassembly 192 to the guarding position illustrated in FIG. 1 by exerting a downwardly acting resilient bias on the lateral guard bars 196 and 198 so that these guard bars are resiliently urged into contact with the upper blade guard stop plates 174 and 176. It will be understood that the bias of the torsion springs 204 and 206 can be overcome by a force acting upwardly against the lower sides of the lateral guard bars 196 and 198, or against the underside of the horn 200 so as to pivot the upper guard subassembly 192 about its pivotal axis which coincides with the axis of the transversely extending pivot bar 202.

Use and Operation

In using the combination portable and stationary, bench-mounted chain saw apparatus of the invention, the stationary mode of usage in which the chain saw is employed for cutting a small, stationarily held workpiece positioned on the table 12 is illustrated in the Figures of the drawing. In this mode of usage, the portable chain saw 142 is retained in a fixed relationship to the cradle frame subassembly 90 by the firm retention of the mounting plate 154 of the saw in the cradle frame 96. With the saw thus mounted, it may be pivoted upwardly to the phantom line position shown in FIG. 1 by pulling back on either of the handles 146 or 148 so as to cause the cradle frame subassembly 90 to pivot upwardly about the pivotal axis which is coincident with the rocking shaft.

When the cradle frame subassembly 90 and portable chain saw structure 142 have thus been pivoted upwardly, the cradle subassembly may be locked in this position by extending the threaded portion of the T-shaped latching rod 104 through the notch or recess 78 formed in the center of the latching bar 76 which extends between the side plates 70 and 72 of the pedestal subassembly 68. The wing nut 108 is then tightened to assure retention of the cradle frame subassembly 90 and portable saw structure 142 in this position.

In this elevated position, the saw structure can be easily started by the use of a pull lanyard in the case of gasoline powered saws, or by other suitable means. It will be noted that in the upwardly extending starting position, the upper run of the saw blade 160 is fully guarded by the upper blade guard subassembly 192. Also, the lower run of the saw blade 160 is spaced from the upper surface of the deck 20 of the table 12 so that there is no possibility of cutting into the planks 22 of the deck.

Prior to actually starting the chain saw structure 142, a workpiece to be cut is positioned on the upper surface of the deck 20 of the table 12 in the desired position for cutting. Where, for example, a 2 × 4 foot piece of lumber, or other elongated wooden workpiece, is to be severed along a saw line which extends normal to the longitudinal axis of the workpiece, the workpiece is abutted along one side thereof against the guide rails 24, 26 and 28 so that the location along the workpiece where the cut is to be made lies immediately over the sawing groove 30 formed in the upper surface of the deck 20. The workpiece is preferably clamped in this position using suitable clamps which may be employed to engage the guide rails 24–28, or the side edges of the deck 20. The portable chain saw structure 142 is then released from its upwardly pivoted position by loosening the wing nut 108, and lifting the T-shaped latching rod 104 out of the notch 78 in the latching bar 76.

Using the handle 146, the saw structure 142 is then slowly pivoted downwardly until it assumes the full line horizontally extending position illustrated in FIG. 1, or approaches closely to this position. At this time, the lower run of the saw blade 160 will be brought into contact with the workpiece and, by aligning the saw blade with the sawing groove 30 across the upper surface of the deck 20, the cut through the workpiece will be made at a true right angle, and at the location where the sawing groove 30 passes between the guide rails 26 and 28. At this time, the pedestal subassembly 68 and the turntable 34 which supports it will be oriented in the position shown in full lines in FIG. 2. Alignment of the saw blade 160 with the sawing groove 30 is assured by the interlocking effect of the spring biased ball element 46 with one of the hemispherical recesses formed in the upper side of the base member 10.

It will be noted that the extent to which the saw structure 142 and the cradle frame subassembly 90 upon which it is mounted can be pivoted downwardly about the rocking shaft 80 is limited by the adjustable stop screw 86 which contacts the lower side of the base plate 94 of the cradle frame subassembly 90. This positive stop assures that after the saw blade 160 has cut completely through the workpiece, the lower run of the blade still will not extend to the bottom of the saw groove 30, and thus will not cut this saw groove any deeper or weaken the planks of the deck 20.

In many instances, it is desirable to form a mitered cut through a workpiece with the angle of cut extending at a 45° angle with respect to the longitudinal axis of the workpiece. In such instances, the workpiece again is abutted against the guide rails 26 and 28 so as to cross the gap therebetween, and to thus overlie the sawing groove 32. In this position, the sawing groove 32 will extend at a 45° angle with respect to the longitudinal axis of the workpiece.

The chain saw structure 142 is then pivoted upwardly on the cradle frame subassembly 90, and the saw structure and supporting substructure are then pivoted about a vertical axis by swinging the pedestal subassembly 68 and the turntable 34 upon which it is mounted. The vertical axis of pivotation coincides with the axis of the bolt 38 by which the plate 36 of the turntable 34 is pivotally mounted on the base member 10. Prior to commencing the swinging movement of the turntable 34, however, the plunger 56 is pulled upwardly against the coil spring 52 to release the ball element 46 from engagement with the receiving hemispherical aperture in the upper side of the base member 10. This frees the plate 36 of the turntable 34 to rotate about a vertical axis, and to swing from the solid line position to the dashed line position shown in FIG. 2. When the turntable 34 swings into the dashed line position, it is arrested at the illustrated position by contact with the adjusting screw 66 of the stop subassembly 60. Moreover, at this time, the spring biased ball element 46, under the bias of the coil spring 52, is caused to move downwardly and engage the hemispherical recess formed in the upper surface of the base member 10 at a location preselected to assure alignment of the plane of the saw blade 160 and blade guide plate 156 with the sawing groove 32.

Using one or both handles 146 and 148, the chain saw structure 142 and the cradle frame subassembly 90 which supports it can then be pivoted downwardly so that the blade and guide plate extend through the space between the guide rails 26 and 28, and come into contact with the workpiece abutted against the inner side of these rails. As the blade 160 of the saw structure 142 cuts through the workpiece, it will cut precisely along a line which extends at a 45° angle with respect to the longitudinal axis of the workpiece. As previously explained, the adjustable stop screw 86 will function to prevent downward pivotation of the cradle frame subassembly 90 to a location such that it will cut into the planks 22 forming the deck 20 at the upper side of the table 12.

In the portable mode of usage of the chain saw apparatus of the invention, the portable chain saw structure 142 must be released from the cradle frame subassembly 90. To accomplish this, the pivoted closure bar 120 is unlatched by loosening the wing nut 132 and then slipping the circular eye 134 down over the latching protuberance 136. The pivoted closure bar 120 can then be pivoted upwardly about the pivot pin 126 so that the rectangular mounting plate 154 is free to slide upwardly and out of the cradle frame 96. The portable chain saw structure 142 can thus, at this time, be lifted upwardly by means of the handles 146 and 148 to completely remove it from the cradle frame subassembly 90 and restore its normal portability.

It should be pointed out that the portable chain saw structure 142 is adapted, when thus removed from the cradle subassembly 90, to receive and carry a second or lower blade guard subassembly constructed substantially identical to the upper blade guard subassembly 192. All that is required to accomplish the mounting of the lower blade guard subassembly on the mounting plate 154 is the removal of one of the lower journal brackets 186 or 188 to permit the transversely extending pivot bar forming a portion of the lower blade guard subassembly to be inserted in the other of the lower journal brackets. The free end of the transversely extending pivot bar of the lower blade guard assembly is then inserted into the removed journal bracket, and the latter is resecured to the face of the mounting plate 154. The saw is thus then equipped with dual upper and lower blade guard structures which function to perform a full and effective guarding of the saw blade in the manner described in Cartmill U.S. Pat. No. 3,991,470.

It will be apparent of course, that at such time as it is desired to remount or reposition the chain saw structure 142 in the cradle frame subassembly 90, this can be quickly and easily accomplished by removing the lower blade guard subassembly, and simply dropping or inserting the mounting plate 154 of the saw structure in the cradle frame 96, followed by relatching of the closure bar 120 across the upper side of the mounting plate to retain it in position.

Although a preferred embodiment of the present invention has been herein described in order to illustrate the basic principles which underlie the invention, it will be understood that various changes and innovations in the described and illustrated structure can be effected without departure from such basic principles. Changes and innovations of this type are therefore deemed to be circumscribed by the spirit and scope of the present invention except as the same may be necessarily circumscribed by the appended claims or reasonable equivalents thereof.

What is claimed is:

1. A table-mounted chain saw apparatus comprising:

a sawing table which includes an upwardly facing deck having, at the upper side thereof, a horizontally extending workpiece-supporting surface;

means adjacent said sawing table for detachably and removably supporting a portable chain saw for independent, selective pivotation about horizontal and vertical axes of pivotation, said means including:

opposed channel frame members for slidingly receiving and cradling a portion of a portable chain saw lowered thereinto; and frame bar means for closing said channel frame members and locking said chain saw rigidly therein; and a portable chain saw including a portion received and cradled in said channel frame members, and further comprising:

a housing for containing a prime mover;

handles on the housing for selectively pivoting the chain saw on said supporting means, and for placing said portion of the chain saw in said opposed channel frame members;

a blade guide plate projecting from said housing, between said channel frame members, and in a plane extending normal to said workpiece-supporting surface;

a flexible chain saw blade extending around the edges of said blade guide plate; and chain guard means including bars extending along said saw blade to shield it from above and at the sides, said guard means being pivotally supported on said saw for pivotation about an axis extending normal to the plane of said blade guide plate.

2. A table-mounted chain saw apparatus as defined in claim 1 and further characterized as including sawing grooves in said deck surface extending at an angle of 45° to each other; and means for fixedly aligning said saw blade with a selected one of said sawing grooves.

3. A table-mounted chain saw apparatus as defined in claim 1 wherein said portion of said chain saw is a rectangular mounting plate having said housing mounted on one side thereof and having said guide plate and saw blade extending through the center thereof.

4. Saw apparatus comprising:

a turntable means pivotable about a vertical axis;

a pedestal subassembly mounted on said turntable means for pivotation therewith;

a cradle frame subassembly pivotally supported on said pedestal subassembly for pivotation about a horizontal axis and including:

a cradle frame;

a horizontally extending base plate having said cradle frame projecting upwardly from one side thereof;

a pair of pivot plates projecting downwardly from the opposite side of said base plate from said cradle frame;

a rocking shaft pivotally connecting said pivot plates to said pedestal subassembly; and latching means for latching the base plate to said pedestal subassembly after pivotation of the base plate to an angle with respect to the horizontal;

a chain saw including a mounting plate slidably inserted in, and removable from, said cradle frame;

a prime mover mounted on one side of said mounting plate;

a saw blade guide plate projecting from said prime mover through said mounting plate; and a saw blade movably mounted on, and guided by, the edges of said guide plate, projecting through said mounting plate and drivingly connected to said prime mover; and a table positioned under said saw blade guide plate for supporting a workpiece to be sawn with said chain saw.

5. A combination portable and stationary, bench-mounted chain saw apparatus comprising:

a base member;

a turntable rotatably mounted on one side of said base member for rotation about a vertical axis;

a vertically extending table mounted on the opposite side of said base member from said turntable and including a horizontally extending deck at the upper side of said table having a horizontally extending workpiece-supporting surface at the upper side thereof;

a portable chain saw including a chain saw blade;

means pivotally supporting the portable chain saw on said turntable for selective pivotal movement about a horizontal axis to swing the chain saw blade upwardly and downwardly in a vertical plane extending normal to the plane of said workpiece-supporting surface while mounting the chain saw to the turntable for rotative movement therewith;

means detachably retaining said chain saw in a fixed sawing position on said means pivotally supporting the saw on the turntable, said means detachably retaining said chain saw comprising:

a cradle frame including a pair of opposed, spaced channel frame members defining channels slidably receiving a portion of said chain saw;

a transversely extending frame element extending between the channel frame members at one of the ends of each of said channel frame members for supporting said portion of said chain saw;

a pivoted closure bar having an end pivotally connected to one of said channel frame members; and latching means on the end of said closure bar opposite its end pivotally connected to one of said channel frame members to releasably retain said portion of said chain saw therein; and indexing and positioning means for selectively extending the chain saw blade at one of multiple chosen angles across said workpiece-supporting surface.

6. The saw apparatus as defined in claim 5 wherein said portion of said portable chain saw slidably received in said channel frame members is a mounting plate having said saw blade projecting from said mounting plate over said workpiece-supporting surface of said plate.

7. The saw apparatus as defined in claim 6 wherein said portable chain saw is further characterized as including means on said mounting frame for selectively pivotally connecting a pair of chain saw guard subassemblies thereto.

8. The saw apparatus as defined in claim 7 wherein said indexing and positioning means comprises:

a pair of spaced stop assemblies on said base member and located to stop the rotation of said turntable after the turntable has rotated through an angle of 45°; and spring biased ball element means carried on said turntable and cooperating with said stop assemblies in arresting rotational movement of said turntable at the ends of said 45° arc of rotational movement.

9. The saw apparatus as defined in claim 8 wherein said deck is further characterized in having divergently angled sawing grooves in said workpiece-supporting surface; and wherein said apparatus is further characterized in including means limiting the downward pivotal movement of said chain saw on said supporting means to pivotation to a position in which a portion of said saw blade will extend in a selected one of said saw grooves without touching said deck.

10. A combination portable and stationary bench-mounted chain saw apparatus comprising:

a base member;

a turntable rotatably mounted on one side of said base member for rotation about a vertical axis;

a vertically extending table mounted on the opposite side of said base member from said turntable and including a horizontally extending deck at the upper side of said table having a horizontally extending workpiece-supporting surface at the upper side thereof;

a portable chain saw including a chain saw blade;

means pivotally supporting the pivotable chain saw on said turntable for selected pivotal movement about a horizontal axis to swing the chain saw blade upwardly and downwardly in a vertical plane extending normal to the plane of said workpiece-supporting surface while mounting the chain saw to the turntable for rotative movement therewith, said means pivotally supporting the portable chain saw on said turntable comprising:

a cradle frame pedestal subassembly mounted on, and rotatable with, said turntable;

means detachably retaining said chain saw in a fixed sawing position on said means pivotally supporting the saw on the turntable, said means detachably retaining said chain saw comprising:

a cradle frame subassembly pivotally supported on said pedestal subassembly for pivotation about a horizontal axis and detachably carrying said chain saw, said cradle frame subassembly further including:

a cradle frame including a pair of opposed, spaced channel frame members defining channels slidably receiving a portion of said chain saw;

a transversely extending frame element extending between the channel frame members at one of the ends thereof for supporting said portion of said chain saw;

a pivoted closure bar having an end pivotally connected to one of said channel frame members;

latching means on the end of said closure bar opposite its end pivotally connected to one of said channel frame members for latching the closure bar across said channel frame members to releasably retain said portion of said chain saw therein; and indexing and positioning means for selectively extending the chain saw blade at one of multiple chosen angles across said workpiece-supporting surface.

11. Saw apparatus comprising:

a base member;

turntable means secured to the upper side of said base member and mounted thereon for pivotation about a vertical axis;

a pedestal subassembly mounted on said turntable means for pivotation therewith;

a cradle frame subassembly pivotally supported on said pedestal subassembly for pivotation about a horizontal axis and including a cradle frame having:

a pair of spaced channel frame members;

a pivoted closure bar having a first end pivotally connected to one of said channel frame members and having a second end detachably connectable to the other of said channel frame members; and said cradle frame subassembly being further characterized in including:

a horizontally extending base plate having said cradle frame projecting upwardly from one side thereof;

a pair of pivot plates projecting downwardly from the opposite side of said base plate from said cradle frame;

a rocking shaft pivotally connecting said pivot plates to said pedestal subassembly; and latching means for latching the base plate to said pedestal subassembly after pivotation of the base plate to an angle with respect to the horizontal;

a chain saw including:

a mounting plate slidably inserted in, and removable from, said spaced channel frame members of said cradle frame;

a prime mover mounted on one side of said mounting plate;

a saw blade guide plate projecting from said prime mover through said mounting plate; and a saw blade movably mounted on, and guided by, the edges of said guide plate, projecting through said mounting plate and drivingly connected to said prime mover;

a table secured to the upper side of said base member and spaced below said chain saw blade and guide plate, and horizontally spaced from said prime mover of said chain saw and said cradle frame, said table including a deck having a horizontally extending upper surface having a plurality of divergently angled saw grooves therein; and wherein said pedestal subassembly is further characterized as including stop means for limiting pivotation of said cradle frame subassembly downwardly about said horizontal axis of pivotation thereof to a position in which the lowest portion of said saw blade extends in one of said saw grooves without touching said horizontally extending upper surface of said deck.

* * * * *